US007633455B2

(12) United States Patent
Yamagajo et al.

(10) Patent No.: US 7,633,455 B2
(45) Date of Patent: Dec. 15, 2009

(54) PLANE ANTENNA

(75) Inventors: Takashi Yamagajo, Kawasaki (JP); Toru Maniwa, Kawasaki (JP); Andrey Andrenko, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 36 days.

(21) Appl. No.: 11/589,914

(22) Filed: Oct. 31, 2006

(65) Prior Publication Data

US 2007/0229384 A1 Oct. 4, 2007

(30) Foreign Application Priority Data

Mar. 28, 2006 (JP) ..... 2006-089168

(51) Int. Cl.
*H01Q 19/10* (2006.01)
*H01Q 9/28* (2006.01)

(52) U.S. Cl. ..... 343/818; 343/795

(58) Field of Classification Search ..... 343/793, 343/795, 818, 819, 866, 867, 700 MS, 725, 343/726

See application file for complete search history.

(56) References Cited

U.S. PATENT DOCUMENTS 5,021,799 A 6/1991 Kobus et al.
6,339,406 B1 * 1/2002 Nesic et al. ..... 343/797
6,417,816 B2 * 7/2002 Sadler et al. ..... 343/795
6,888,511 B2 * 5/2005 Cake ..... 343/803
7,292,200 B2 * 11/2007 Posluszny et al. ..... 343/803
2004/0090369 A1 * 5/2004 McCarrick ..... 343/700 MS
2005/0057422 A1 3/2005 Deguchi et al.
2005/0116869 A1 * 6/2005 Siegler et al. ..... 343/749
2006/0061515 A1 3/2006 Posluszny
2007/0152903 A1 * 7/2007 Lin et al. ..... 343/795

FOREIGN PATENT DOCUMENTS

GB 2 111 756 A 9/1982

OTHER PUBLICATIONS

Andrey S. Andrenko, *EM Modeling and Optimization of Integrated Printed Antennas for Multiband Wireless Communications*, 10.1-3. 2003, pp. 179-184.
Extended European Search Report, Application No. 06123745.9-2220, Reference No. 118 330 a/jme, Jul. 12, 2007.

* cited by examiner

*Primary Examiner*—Hoang V Nguyen
*Assistant Examiner*—Robert Karacsony
(74) *Attorney, Agent, or Firm*—Hanify & King, PC

(57) ABSTRACT

A plane antenna comprises a substrate having a first surface and a second surface, a first radiating element, a first power feeding pattern connected to the radiating element, and a first non-power feeding loop type radiating element provided adjacent to the first radiating element, all disposed on the first surface of the substrate, and a second radiating element, a second power feeding pattern connected to the radiating element, and a second non-power feeding loop type radiating element provided adjacent to the second radiating element, all disposed on the second surface of the substrate.

11 Claims, 15 Drawing Sheets

FIG. 6-A
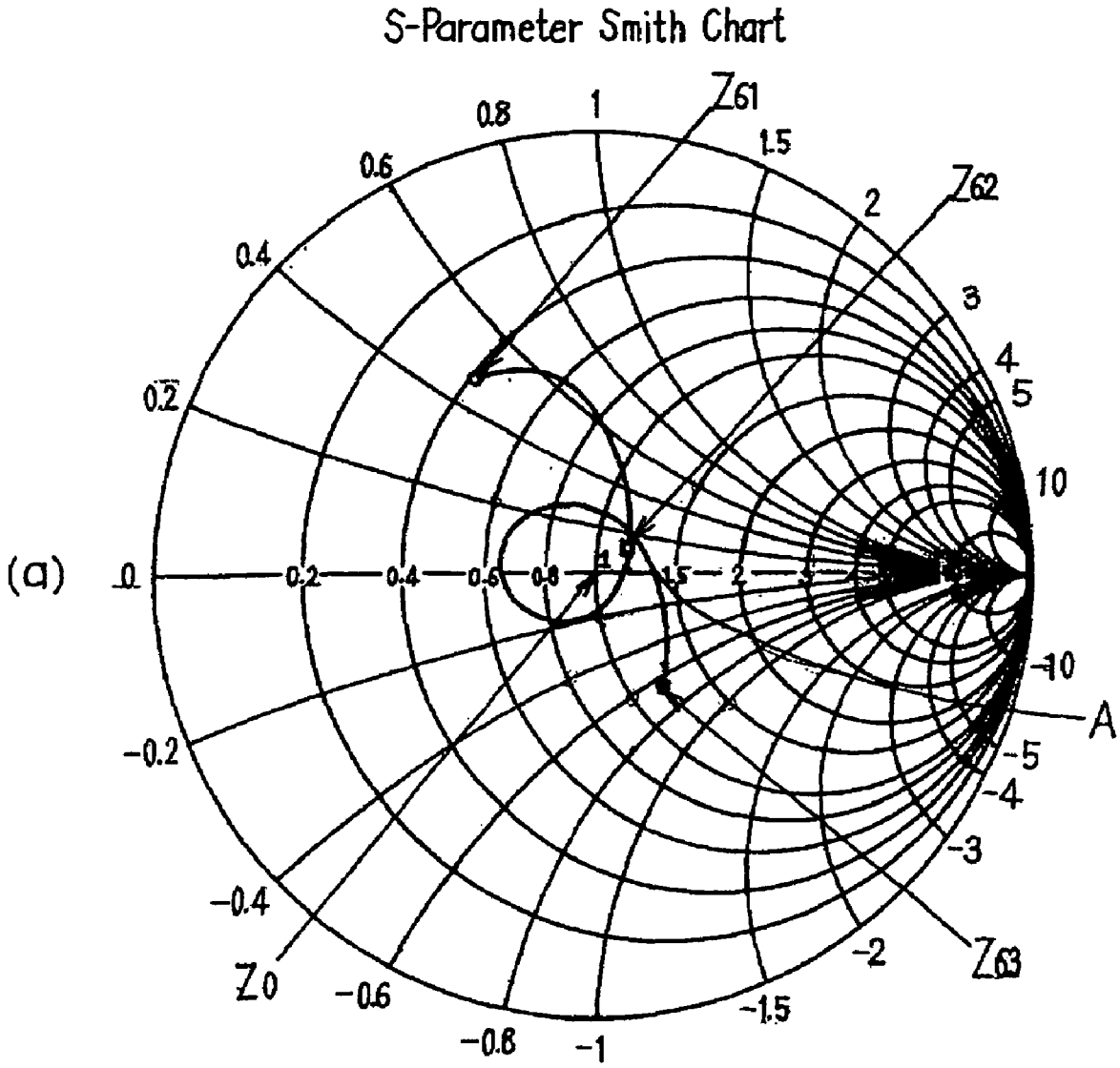

FIG. 6-B
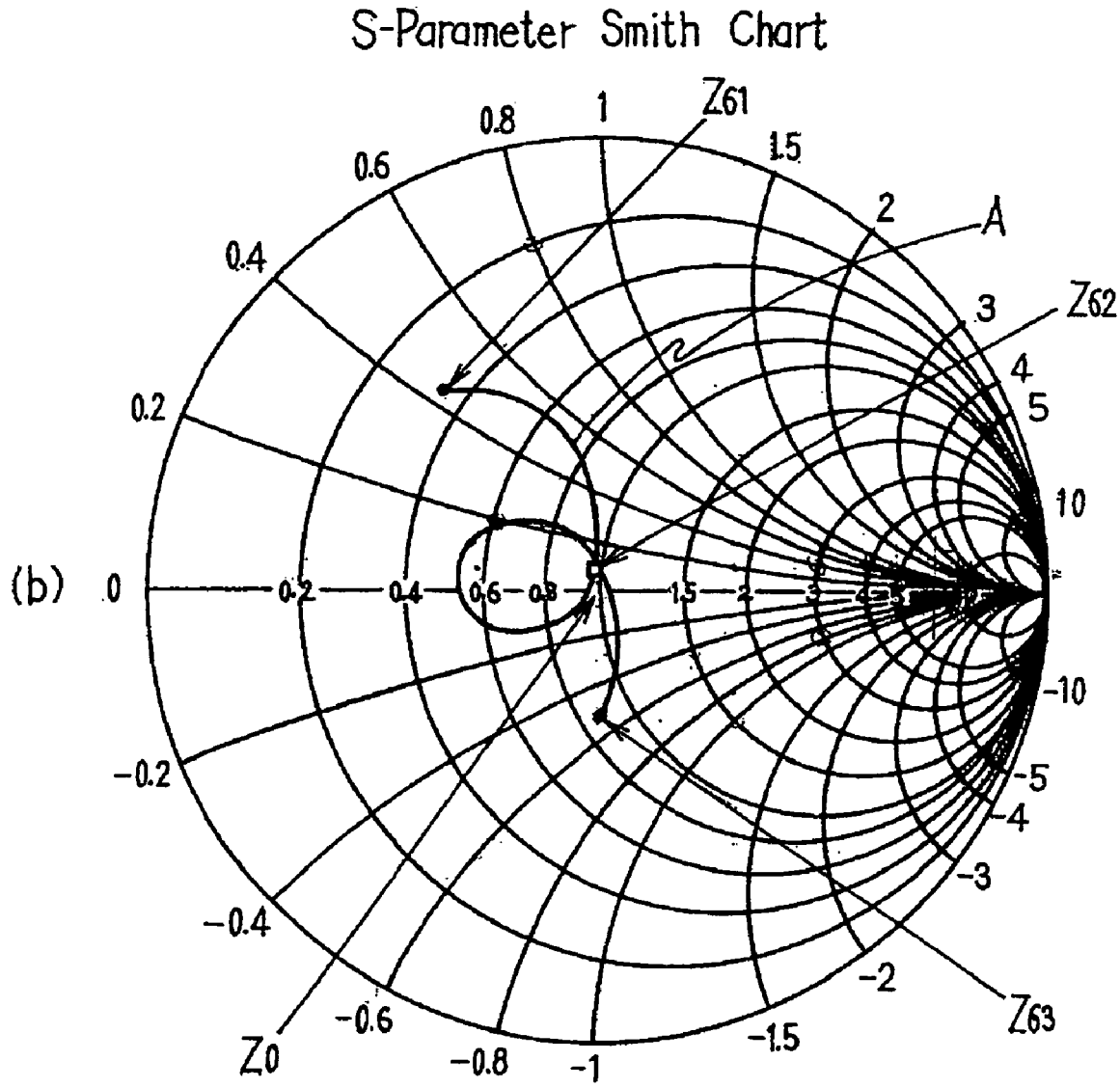

FIG. 6-C
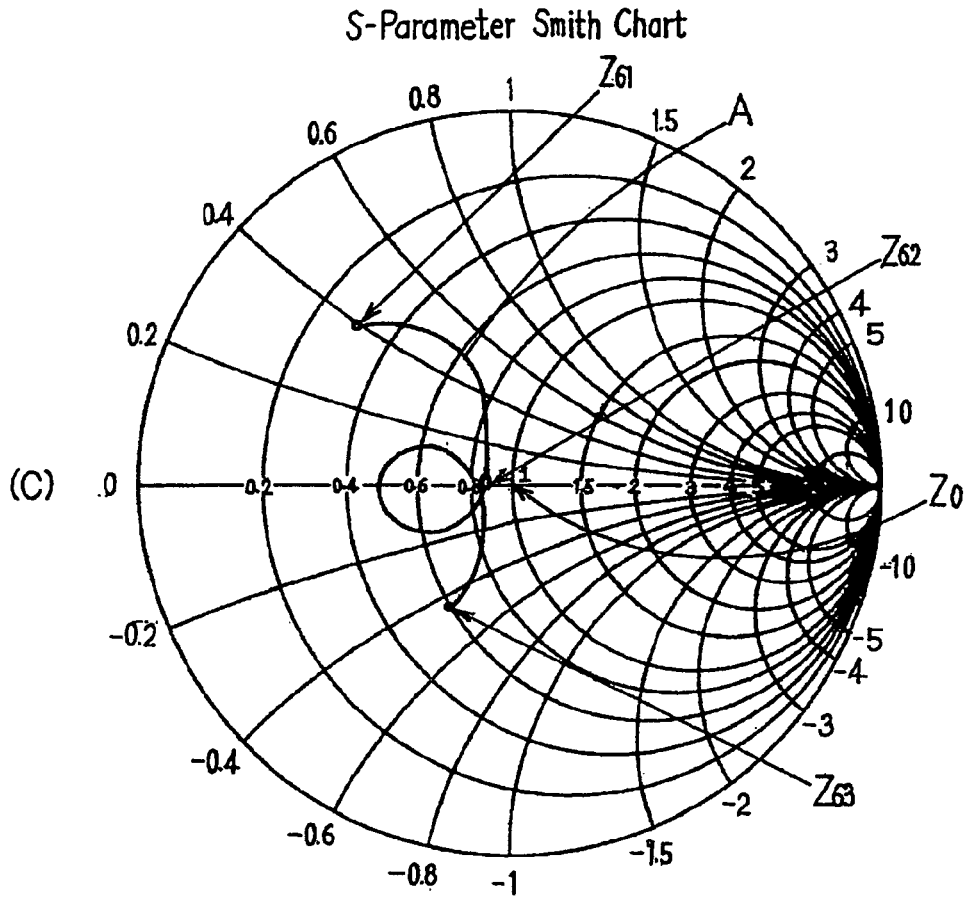
FIG. 7
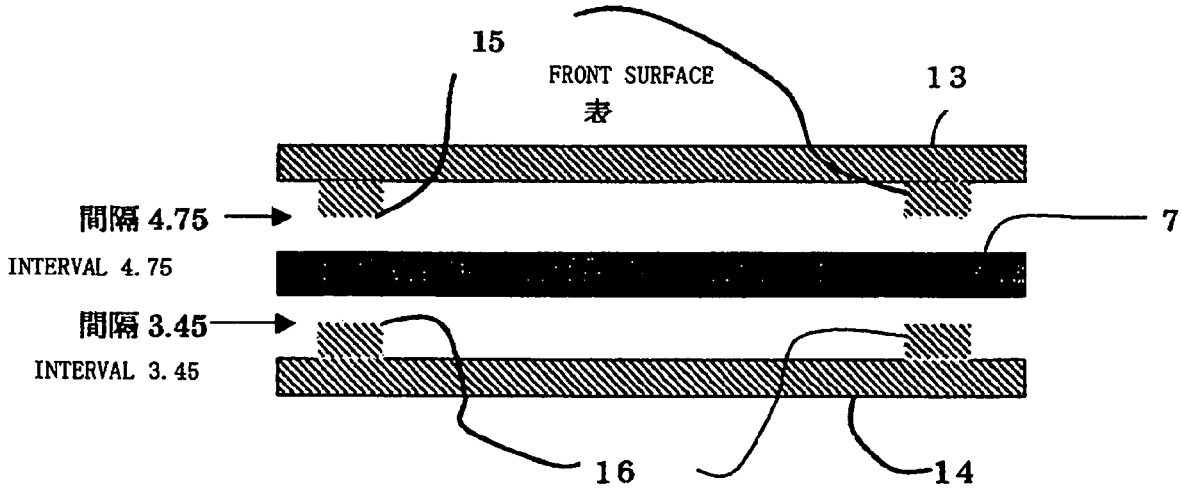

FIG. 8-A
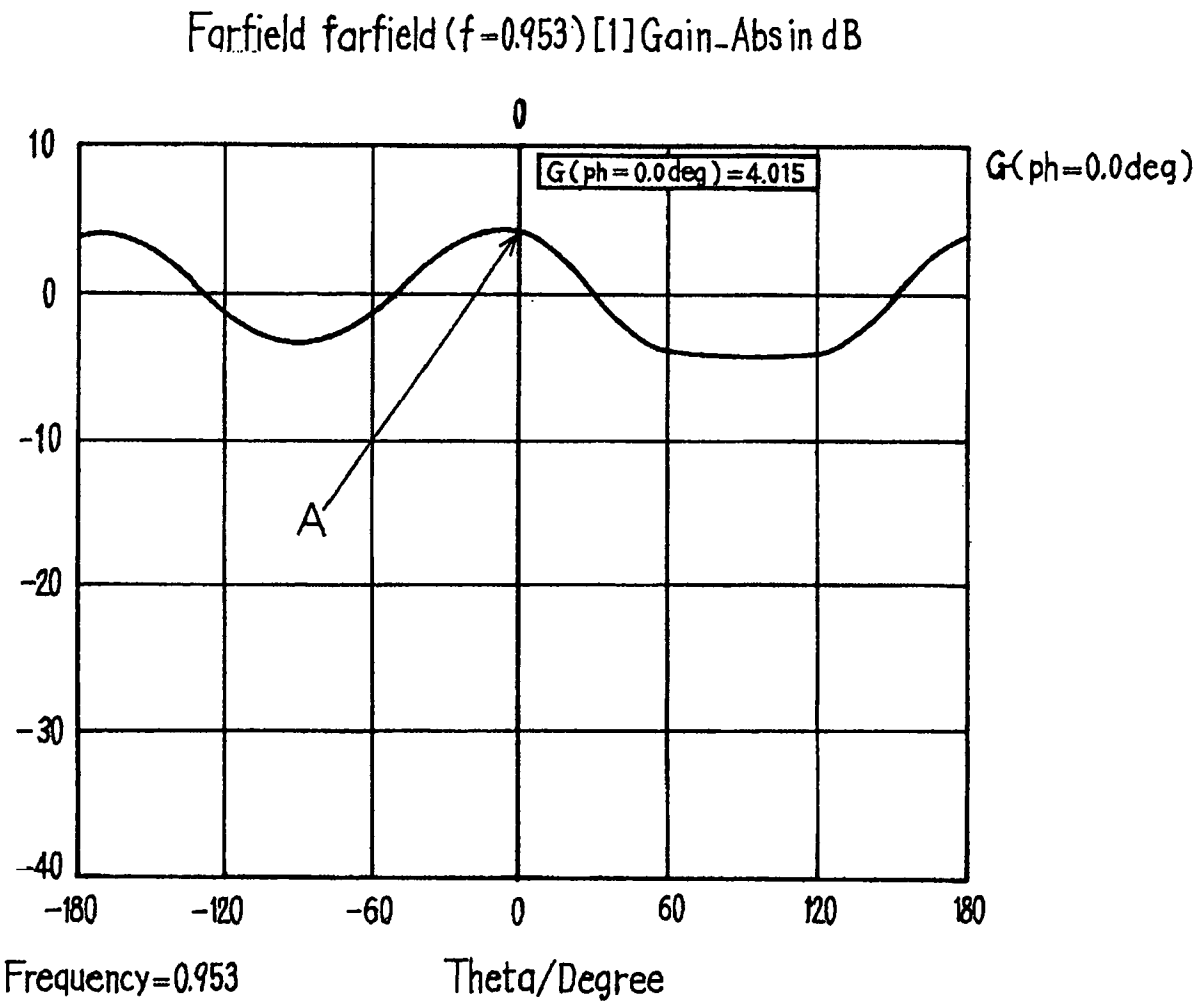
(a)

FIG. 8-B
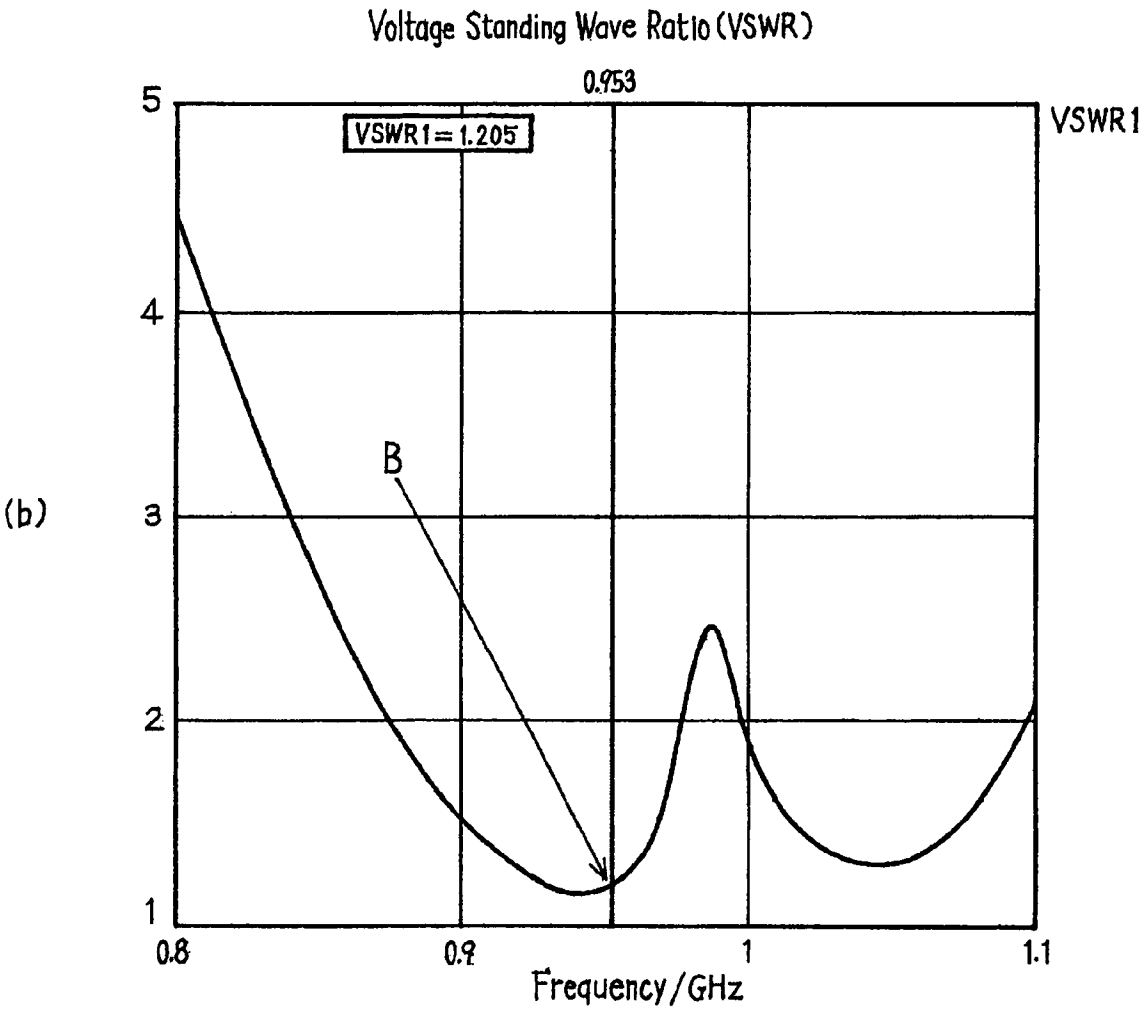
(b)

FIG. 8-C
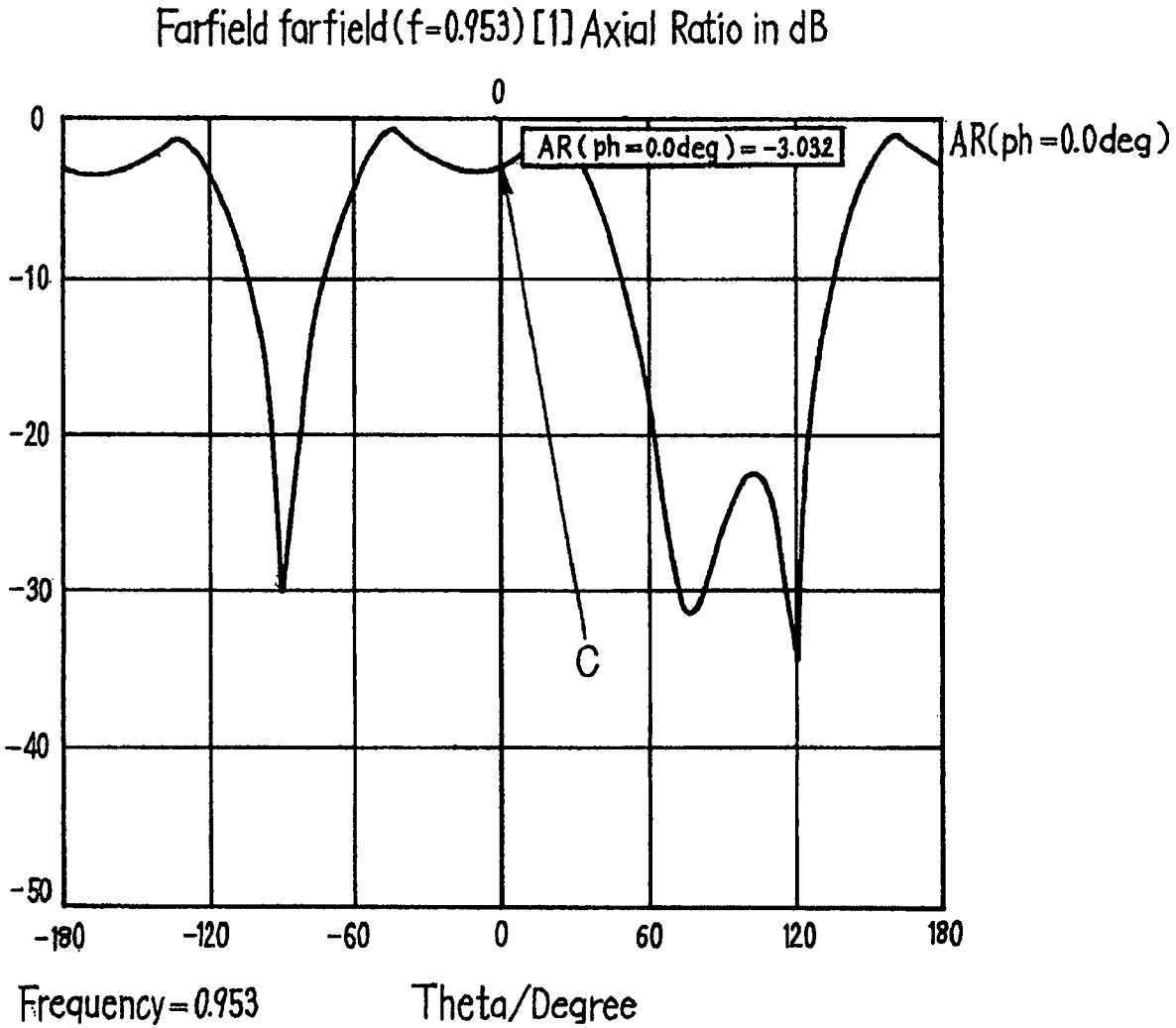
(C)

PLANE ANTENNA

BACKGROUND OF THE INVENTION

1. Field of the Invention

The present invention relates to a plane antenna and more specifically to the technology suitable for antenna formed on a dielectric material substrate to generate circularly polarized wave.

2. Background of the Prior Art

In recent years, a vehicle (mobile) such as an automobile has often been provided with an antenna for GPS (Global Positioning System) in the high frequency band or an antenna for receiving radio waves from satellites for satellite digital broadcasts. Moreover, it is also required for a mobile vehicle to install an antenna for transmitting and receiving radio waves for the ETC (Electronic Toll Collecting) system for automatically collecting tolls on expressways and toll roads and for radio wave beacons of the VICS (Vehicle Information Communication System) for providing vehicle traffic information.

For the GPS radio wave, satellite wave for satellite digital broadcast and ETC radio wave, among the radio waves to be transmitted and received with the mobile vehicle explained above, a circularly polarized wave has been used. A patch antenna (plane antenna) has often been used as an antenna for circularly polarized waves in the related art.

FIG. 1 is a schematic plan view illustrating an example of the plane antenna in the related art and also illustrating a structure of a plane antenna provided in Japanese Patent Application JP-A 2005-102183. The plane antenna illustrated in FIG. 1 can receive a right-hand circularly polarized wave and is constituted by forming, on a dielectric material (transparent film) not illustrated, a square loop antenna (power feeding element) and an independent line conductor (non-power feeding element) 140 which is partly bent to include a first part 140A and a second part 140B and is not connected to the loop antenna 120. The reference numeral 270 denotes a tie conductor as a connecting conductor for connecting power feeding terminals 160, 170 and the loop antenna 120 and the code CP denotes the central point of the loop antenna 120, respectively.

Moreover, as illustrated in FIG. 1, the non-power feeding element 140 is arranged at the area near the external side of the loop antenna 120. In more detail, the first part 140A is arranged in parallel to the loop antenna 120 and the second part 140B is arranged in parallel to the line connecting the intermediate point of the power feeding terminals 160, 170 and the vertex opposing to this intermediate point.

Functions of this non-power feeding element 140 will be explained with reference to the description of the paragraph 0069 of Japanese Patent Application JP-A 2005-102183. A loop antenna 120 not provided with the non-power feeding element 140, particularly a loop antenna 120 having a circumference (total length of the antenna conductor) equal to one wavelength, can receive only the electric field element (horizontal element) in the perpendicular direction (namely, cannot perfectly receive the circularly polarized wave changing the direction of electric field in accordance with time) but can also receive the vertical element of the circularly polarized wave in the case where the non-power feeding element 140 is provided adjacent to the loop antenna 120.

That is, it becomes possible that the vertical element of the circularly polarized wave is received with the second part 140B of the non-power feeding element 140 and the received vertical element is coupled with the antenna conductor of the loop antenna 120 with the first part 140A adjacent to the antenna conductor of the loop antenna 120. As a result, the vertical element and the horizontal element of the circularly polarized wave can be received with the loop antenna 120 in the in-phase state. In other words, if the non-power feeding element 140 is formed of only the second part 140B, the received circularly polarized wave is not easily transferred to the loop antenna 120. Therefore, the first part 140A is provided to the non-power feeding element 140 in order to effectively transfer the received circularly polarized wave to the loop antenna 120.

The technologies proposed, for example, in Japanese Patent Applications JP-A 2005-72716 and JP-A 1997-260925 are also utilized as the antenna structures in the related art. The technology of Japanese Patent Application JP-A 2005-72716 proposes a thin plane structure formed of a plurality of double-loop antenna elements and relates to an antenna structure for simultaneously generating the left-hand circularly polarized wave and the right-hand circularly polarized wave from both directions.

Meanwhile, the technology of Japanese Patent Application JP-A 1997-260925 relates to a structure where a dipole antenna, a loop antenna, and a plane antenna, which are smaller than a square row antenna, are arranged at the internal side thereof within the plane of the antenna in order to provide optimum directivity of respective antennas formed with mutual interferences of a plurality of antennas.

However, it has been difficult for the technology proposed in Japanese Patent Application JP-A 2005-102183 to obtain sufficient circularly polarized wave characteristics because electric field distribution to the non-power feeding element 140 is rather weak due to its structural features. A reason to be considered is that when a line antenna such as a dipole antenna or the like is simply formed on a dielectric material substrate, the beam is mainly formed in the direction along the plane part of the dielectric material substrate and thereby radiation intensity in the direction crossing the plane part of the dielectric material substrate (namely, in the thickness direction) is reduced.

The technology of Japanese Patent Application JP-A 2005-72716 is intended to simultaneously generate a left-hand circularly polarized wave and a right-hand circularly polarized wave. The technology of Japanese Patent Application JP-A 1997-260925 is intended to enable a reduction in size of the antenna by closely or integrally providing a plurality of antennas within a narrow place and to prevent noise from the inside of the vehicle. Namely, Japanese Patent Applications JP-A 2005-72716 and JP-A 1997-260925 are not intended to obtain excellent circularly polarized wave characteristics.

SUMMARY OF THE INVENTION

The present invention has been proposed considering the problems explained above and an object of the present invention is therefore to provide a plane antenna which can attain an excellent circularly polarized wave with a simplified structure. The plane antenna of the present invention can be applied not only to mobile bodies such as vehicles or the like but also to a stock management system for, for example, the books arranged on the bookshelves of a book shop or library, a POS system, and a security system or the like, for preventing shoplifting of products.

In order to achieve the objects explained above, according to the first profile of the present invention, as the plane antenna constituted with a dipole antenna formed of a couple of radiating elements spreading in both sides from a power feeding unit and an unbalanced-to-balanced converting unit, a plane antenna is used, in which one surface of a substrate is provided with a first radiating element, a first power feeding pattern connected to the radiating element, and a first radiating element in the form of non-power feeding loop (first non-power feeding loop type radiating element), and the other surface of the substrate is provided with a second radiating element, a second power feeding pattern connected to the radiating element, and a second non-power feeding loop type radiating element provided adjacent to the second radiating element.

In one embodiment, a plane antenna comprises a substrate having a first surface and a second surface, a first radiating element, a first power feeding pattern connected to the radiating element, and a first non-power feeding loop type radiating element provided adjacent to the first radiating element, all disposed on the first surface of the substrate, and a second radiating element, a second power feeding pattern connected to the radiating element, and a second non-power feeding loop type radiating element provided adjacent to the second radiating element, all disposed on the second surface of the substrate.

In one aspect of the present invention, the first and second radiating elements form a dipole antenna.

In one aspect of the present invention, the plane antenna further comprises an impedance-adjusting unit provided to a part of at least one of the first and second radiating elements.

In one aspect of the present invention, the plane antenna further comprises an impedance-converting unit formed by changing a part of a pattern width of at least one of the first or second power feeding patterns of the plane antenna.

In one aspect of the present invention, at least one of the first and second power feeding patterns of the plane antenna is formed in a shape of a triangle with the power feeding side defined as the bottom side of the triangle and the power feeding point of the radiating element defined as the vertex of the triangle.

In one aspect of the present invention, at least one of the first and second power feeding patterns of the plane antenna is formed in a shape of an isosceles triangle with the power feeding side defined as the bottom side of the triangle and the power feeding point of the radiating element defined as the as the vertex of the triangle.

In one aspect of the present invention, wherein at least one of the first and second non-power feeding loop type radiating elements is further provided with an adjusting unit for adjusting an interval with an adjacent radiating element.

In one aspect of the present invention, the plane antenna further comprises an unbalanced-to-balanced converting unit. The unbalanced-to-balanced converting unit is a part of the first power-feeding pattern and comprises an impedance-adjusting unit. The second power-feeding pattern is provided with an impedance-converting unit formed by changing a part of a pattern width of the second power-feeding pattern.

BRIEF DESCRIPTION OF THE DRAWINGS

FIG. 6-A is a diagram illustrating the Smith chart of the plane antenna when line width of an impedance-converting unit 4 of FIG. 3 is adjusted to 4 mm.

FIG. 6-B is a diagram illustrating the Smith chart of the plane antenna when line width of the impedance-converting unit 4 of FIG. 3 is adjusted to 5 mm.

FIG. 6-C is a diagram illustrating the Smith chart of the plane antenna when line width of the impedance-converting unit 4 of FIG. 3 is adjusted to 6 mm.

FIG. 7 is a diagram illustrating a structure of plane antenna product for circularly polarized wave of the present invention.

FIG. 8-A is a diagram illustrating antenna gain characteristic of the plane antenna product for circularly polarized wave of FIG. 7.

FIG. 8-B is a diagram illustrating VSWR (Voltage to Standing Wave Ratio) characteristic of the antenna as the parameter to know the impedance matching state of the antenna product for circularly polarized wave of FIG. 7.

FIG. 8-C is a diagram illustrating the axial radio characteristic of the circularly polarized wave from the antenna as the plane antenna product for circularly polarized wave of FIG. 7.

DETAILED DESCRIPTION OF THE PREFERRED EMBODIMENTS

Since the plane antenna of the present invention is constituted as explained above, a circularly polarized wave having excellent characteristic in the vertical direction to both sides of a substrate plane can be generated, sufficient radio waves can be supplied to a tag or the like, and the communication distance can be extended.

The plane antenna of the present invention can be reduced in size and cost by eliminating circuits such as a balun or an impedance converting circuit, which are components that are different from the antenna even when electrical power is fed with a coaxial cable.

The plane antenna of the present invention is capable of providing the unbalanced-to-balanced converting unit with a broadband characteristic by shaping the power-feeding pattern to be used to an isosceles triangle.

The preferred embodiments of the present invention will be explained with reference to the accompanying drawings. However, these preferred embodiments do not restrict the technical scope of the present invention.

For the preferred embodiments of the present invention, a structure of a plane antenna for radiating the circularly polarized wave in the perpendicular direction to both surfaces of a substrate will be explained as follows.

Figure 1:
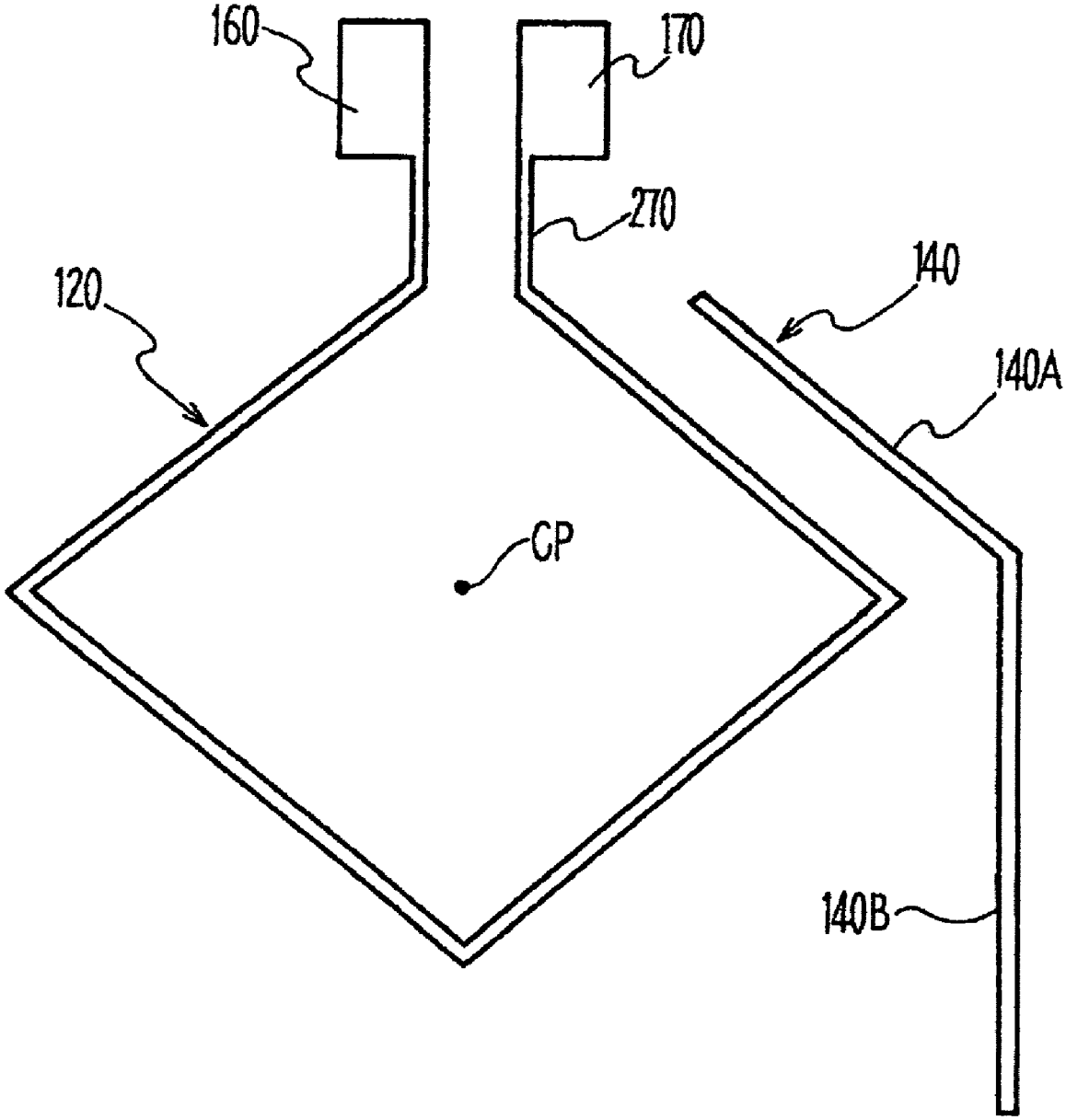
FIG. 1 PRIOR ART
FIG. 1 is a schematic plan view illustrating an example of the plane antenna of the related art.
Figure 2:
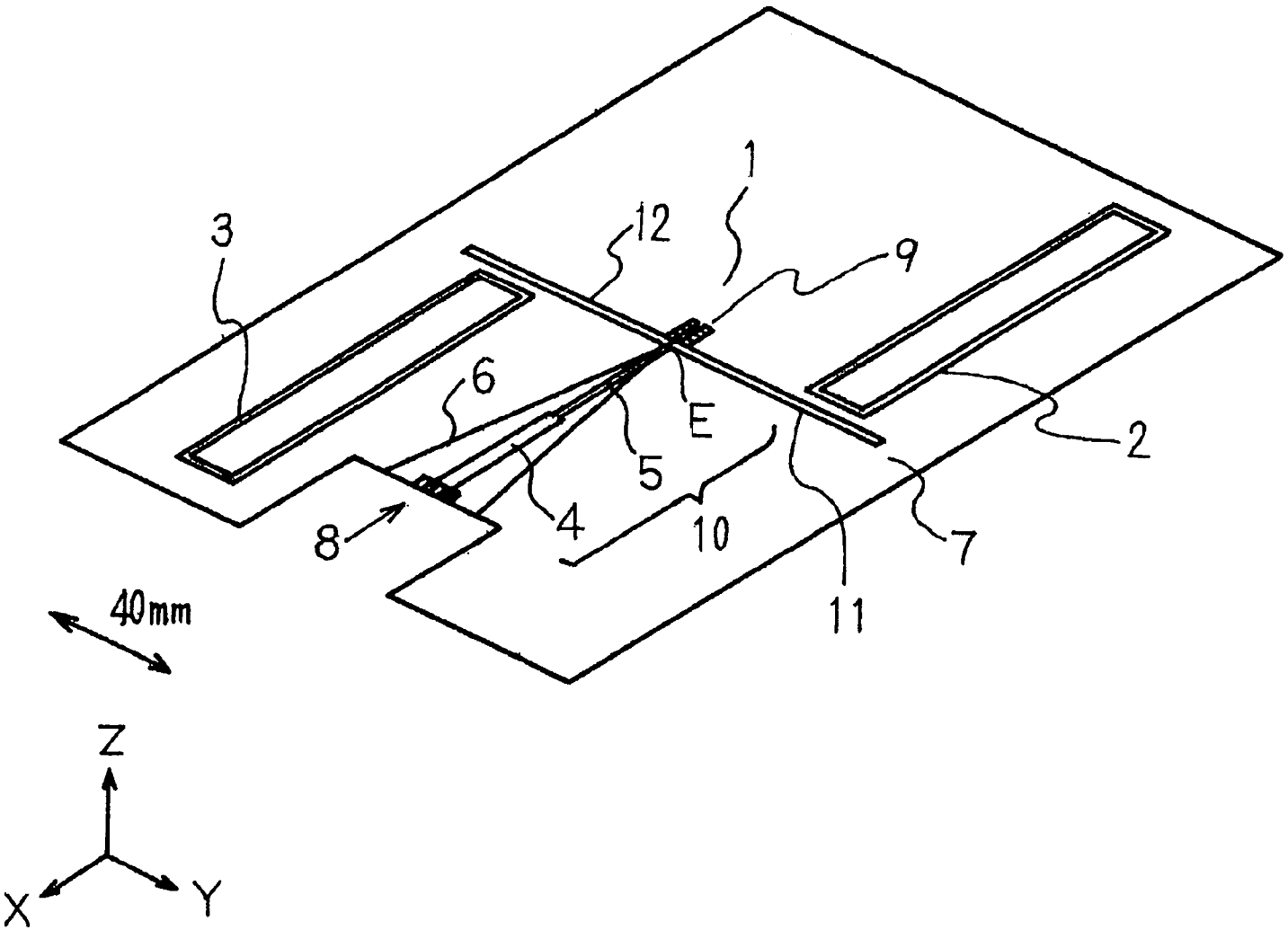
FIG. 2 is a structural diagram of a plane antenna of the present invention.

FIG. 2 is a structural diagram of a plane antenna of the present invention.

This plane antenna is constituted, on the surface of a substrate 7, with a dipole antenna 1, loop antennas 2, 3, a cutaway balun 10, and a connecting terminal 8 for coaxial cable. This dipole antenna 1 is formed of a first antenna element 11 and a second antenna element 12. A stub 9 is formed at a part of the first antenna element 11 and the second antenna element 12. The loop antenna 2 is provided adjacent to the first antenna 11 at its one short side and is located at its long side in the right-angle direction to the first antenna element 11 on the plane of the substrate 7. The loop antenna 3 is provided adjacent to the second antenna element 12 at its short side and is located at its long side in the right-angle direction to the second antenna element 12.

The antenna element explained here is a radiating element.

The cut-away balun 10 is formed of an impedance converting unit 4, a line 5, and a triangular pattern 6. The substrate 7 is formed, for example, of a dielectric material.

The first antenna element 11 and the loop antenna 2 are formed on the front surface of the substrate 7, which is different from the rear surface thereof where the second antenna element 12 and loop antenna 3 are formed. The loop antennas 2, 3 are respectively formed and arranged adjacent to the first and second antenna elements at the point-symmetrical locations at the power feeding point E of the first and second antenna elements 11, 12 and are electromagnetically coupled with the first antenna element and second antenna element 11, 12.

In the plane antenna structure explained above, when electrical power is fed to the dipole antenna 1, the electric field is radiated in the z-axis direction (direction perpendicular to a paper sheet of FIG. 2) so that the dipole antenna 1 has one cross-polarized element and the loop antennas 2, 3 have the other cross-polarized element, which is delayed by 90 degrees in phase and is different by 90 degrees in the polarized wave from the one cross-polarized element.

In more detail, the electric field (Ey field) having the polarized wave (horizontal direction) element in the Y-axis direction is generated with the dipole antenna 1. When this electric field is coupled with the loop antennas 2, 3, current flows in the loop antennas. In this timing, since the loop antennas 2, 3 respectively have the long side in the x-axis direction, the electric field (Ex field) having a polarized wave (vertical polarized wave) intensified in the x-axis direction more than in the Y-axis direction is generated.

As a result, the electric field formed by synthesizing the Ex field and Ey field, namely the circularly polarized wave (in this case, right-hand circularly polarized RHCP) field is generated. In other words, the plane antenna explained above is arranged in a manner so that the loop antennas 2, 3, as the non-power feeding loop type antenna elements, generate the cross-polarized wave (perpendicularly polarized wave) crossing the polarized wave (horizontally polarized wave) generated by the dipole antenna 1 as the line antenna element. Moreover, the loop antennas 2, 3 respectively, include the linear portions extending in the direction to cross the dipole antenna 1 as the long side of the rectangular shape in order to generate the relevant perpendicularly polarized wave.

Here, intensity and phase of the cross field elements crossing orthogonally can be adjusted and can also be approximated to ideal circularly polarized waves by respectively adjusting shapes of loop antennas 2, 3 (shapes of the connecting portions with the dipole antenna 1) and distance in the y-axis direction between the dipole antenna 1 and loop antennas 2, 3 and location in the x-axis direction. The actual adjustment of distance between the dipole antenna 1 and respective loop antennas 2, 3 will be explained later. Moreover, whether components other than the first antenna element 11 and second antenna element 12 forming the dipole antenna of FIG. 2 and the loop antennas 2, 3 are mounted on the front surface or rear surface of the substrate 7 will be explained with reference to FIGS. 3*a* and 3*b*. Therefore, this is not explained here.

The full length of the dipole antenna 1 is about λ/2. The stub 9 is provided for adjustment of impedance at the area near the power feeding point of the dipole antenna 1 and adjusts an antenna impedance viewed from the power feeding point of the antenna. The loop antennas 2, 3 have the full length of one wavelength and are formed of the non-power feeding element. The cut-away balun 10 is formed of a triangular pattern 6, an impedance-converting unit 4, and a line 5 to feed the electrical power to the dipole antenna 1 by converting the power fed from the unbalanced coaxial cable to the balanced power. The triangular pattern 6 is formed in the shape of isosceles triangle with power feeding side defined as the bottom side and the power feeding point of the radiating element as the vertex. Thereby, the cut-away balun 10 is capable of having a broadband characteristic.

The length of impedance converting unit 4 is equal to λ/4.

Figure 3:
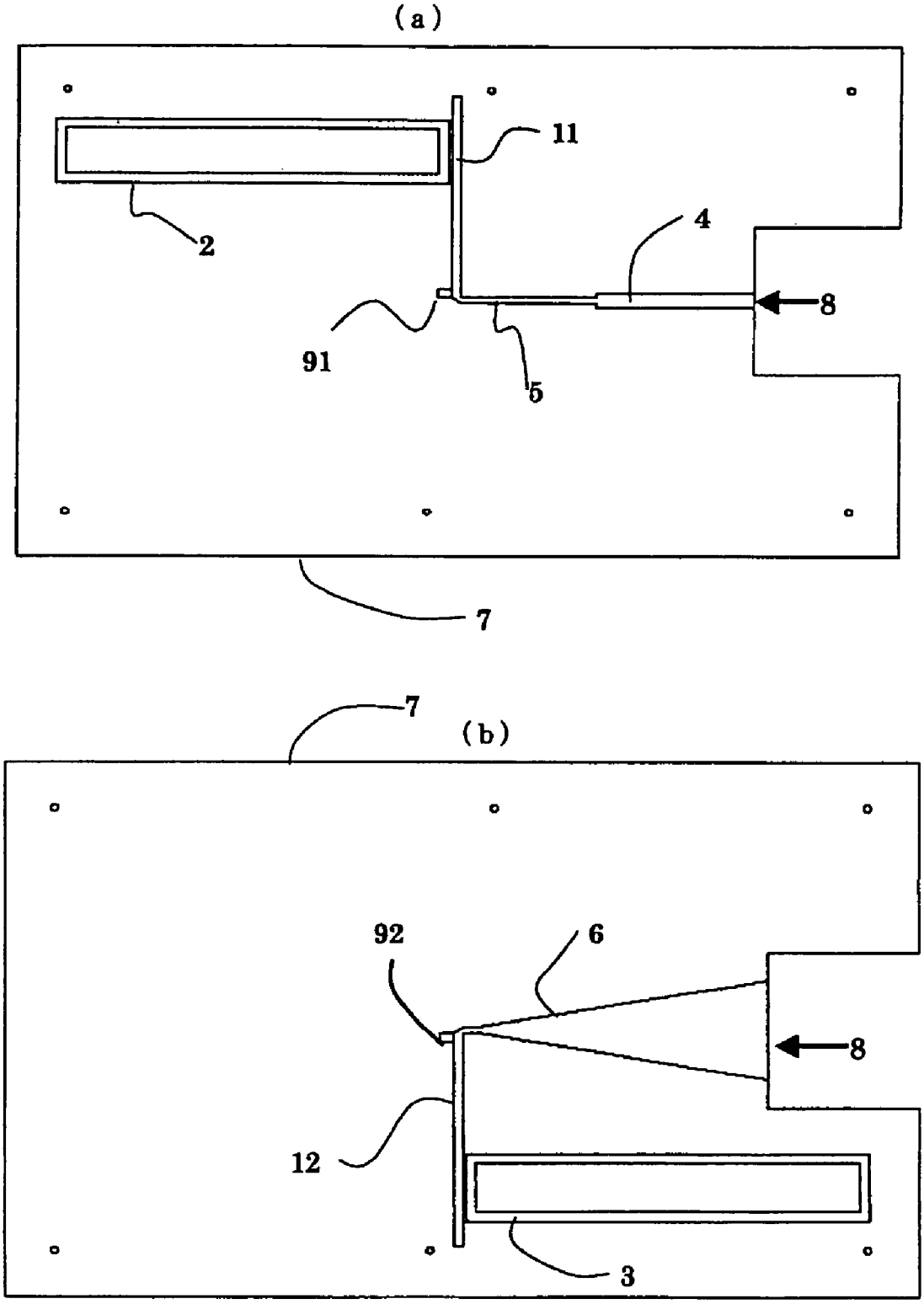
FIG. 3 is a detail structural diagram (a) of the plane antenna of the present invention viewed from the front surface and detail structural diagram (b) of the plane antenna of the present invention viewed from the rear surface.

FIG. 3(*a*) is a more detailed structural diagram of the plane antenna of the present invention viewed from the front surface side. FIG. 3(*b*) is a more detailed structural diagram of the plane antenna of the present invention viewed from the rear surface side.

The front surface of the substrate 7 of the plane antenna of FIG. 3(*a*) is provided with the first antenna element 11 with a length of about λ/4, the loop antenna 2 is arranged so that the short side thereof is parallel to the first antenna element and the long side is located at the right angle thereto. The line 5, the impedance converting unit 4, the stub 91, and the connecting terminal 8 for coaxial cable are provided.

Moreover, the rear surface of the substrate 7 of the plane antenna of FIG. 3(*b*) is provided with the second antenna element 12 with a length of about λ/4, the loop antenna 3 is arranged so that the short side thereof is parallel to the second antenna element 12 and the long side thereof is located in the right angle thereto. The triangular pattern 6, the stub 92, and the connecting terminal 8 for coaxial cable are provided.

Such plane antennas as are illustrated in FIG. 3(*a*) and FIG. 3(*b*) respectively generate a circularly polarized wave in the perpendicular direction to the front surface and rear surface of the substrate 7.

Figure 4:
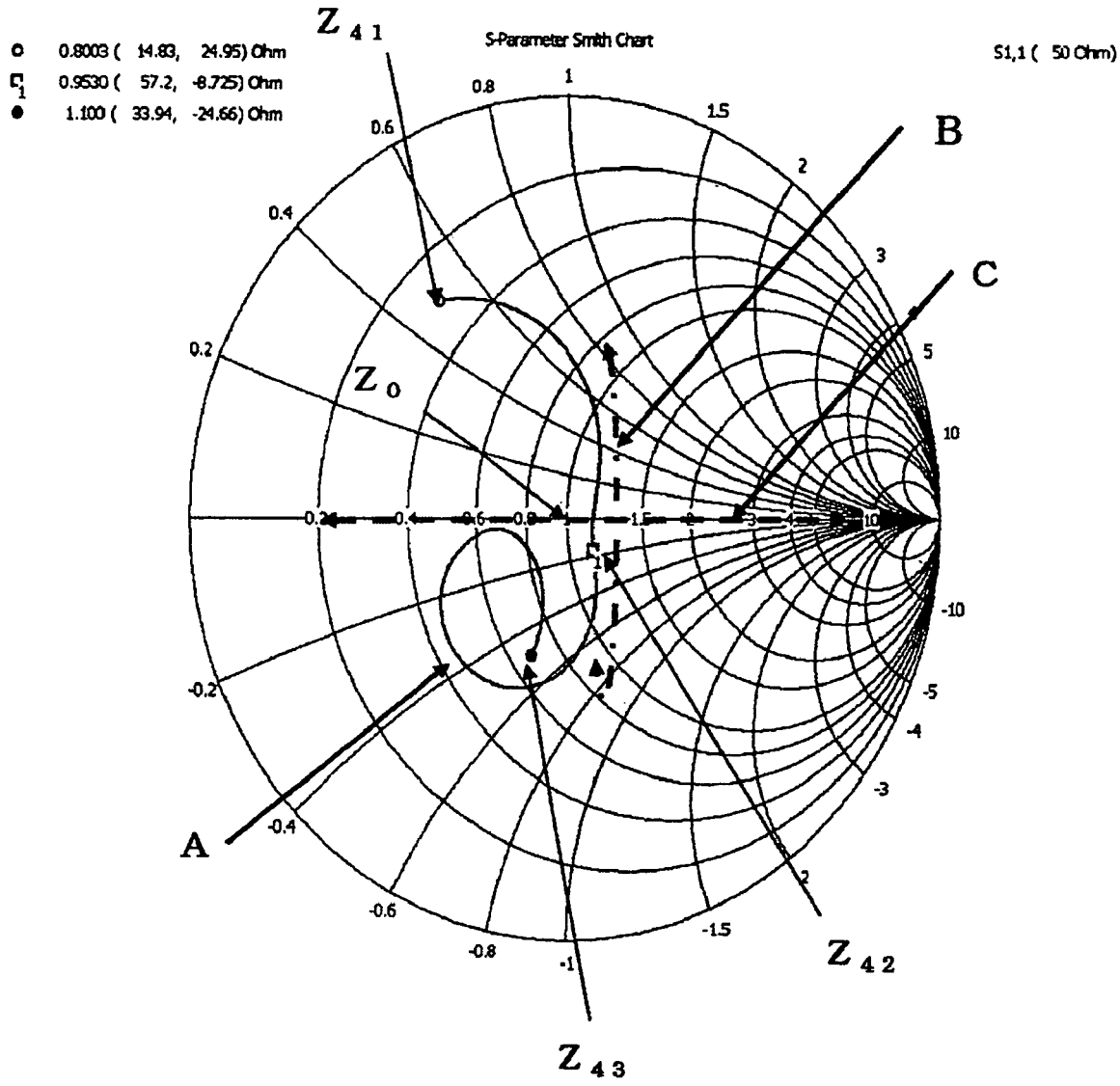
FIG. 4 is a diagram illustrating the Smith chart of the plane antenna of the present invention.

FIG. 4 is a Smith chart of the plane antenna of the present invention.

The curve A in FIG. 4 shows changes of an input impedance of the plane antenna in accordance with frequency. Z41 is impedance when the frequency is 800 MHz. Z42 is the impedance when the frequency is 953 MHz. Z43 is the impedance when the frequency is 1.1 GHz. A reactance element of the antenna changes in the vertical direction (to a negative value from a positive value) like B by changing the length of the stub 91, 92 of FIGS. 3(*a*) and 3(*b*). Moreover, a resistance element of the antenna changes in the horizontal direction (to infinity from 0) like C by changing the line width of the impedance-converting unit 4 of FIG. 3(*a*). Z0 is the point showing the impedance of 50Ω matched with an impedance of a power feeding coaxial cable. An input impedance of the plane antenna can be approximated to Z0 equal to the characteristic impedance of 50Ω of the coaxial cable by adjusting the stub 91, 92, and impedance converting unit 4.

Figure 5A:
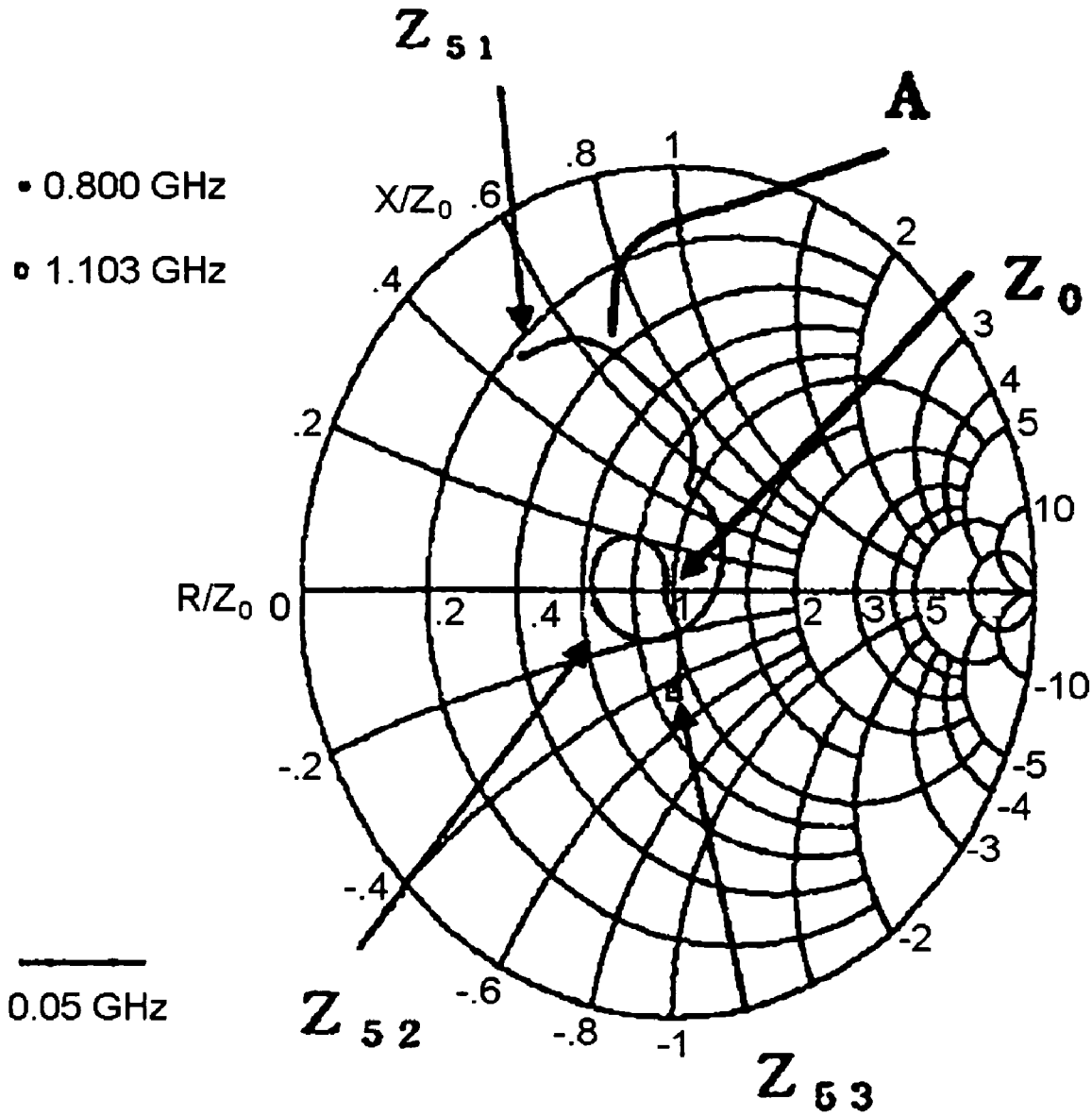
FIG. 5 is a diagram illustrating the Smith chart of the plane antenna when the length of stub is adjusted.
Figure 5B:
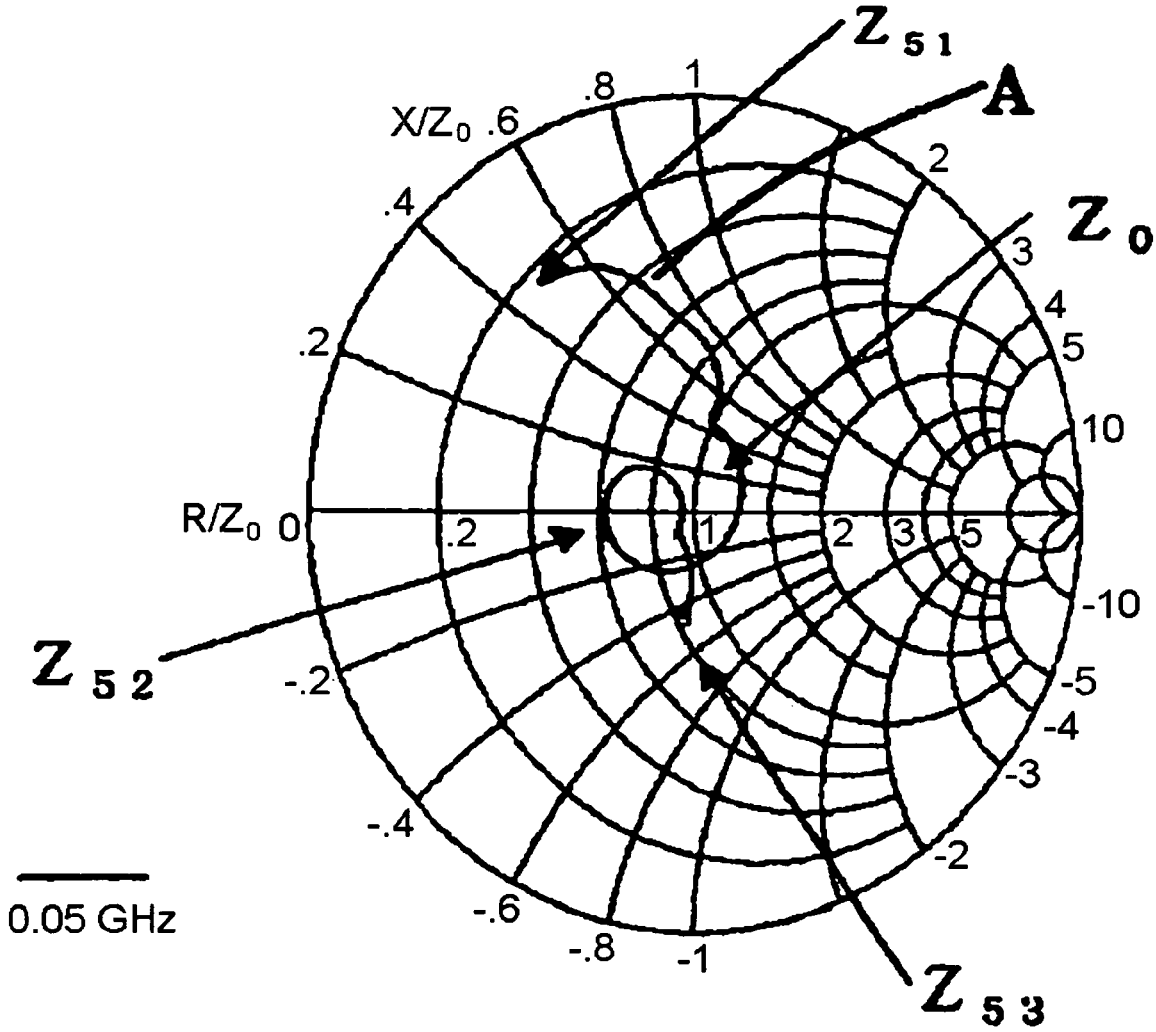
Figure 5:
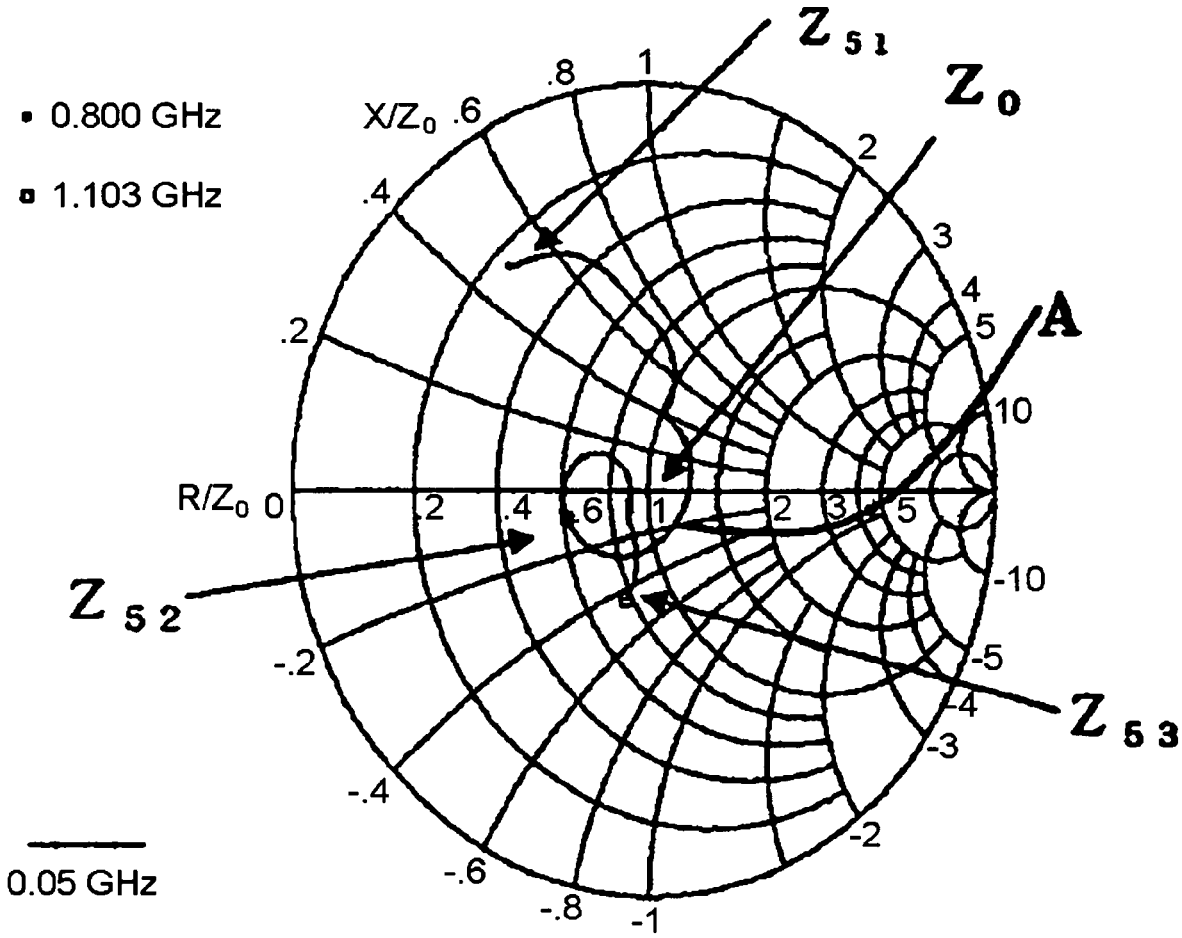
Figure 5D:
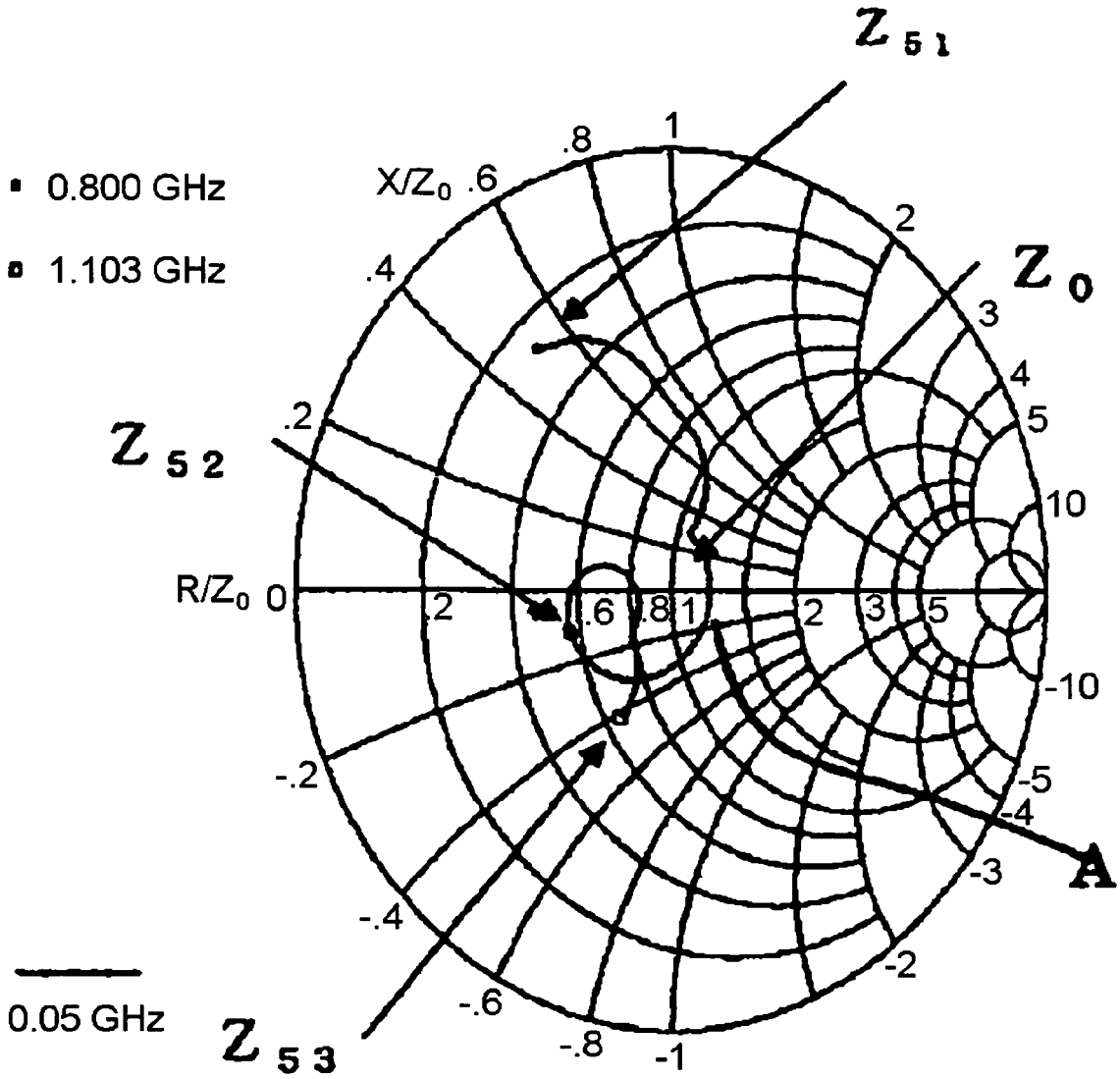

FIG. 5 illustrates the Smith charts of the plane antenna when the length of stub 91, 92 in FIG. 3 is adjusted.

FIGS. 5(*a*) to 5(*d*) are Smith charts of the plane antenna when the length of stub 91, 92 is changed to 2 mm, 4 mm, 6 mm, and 10 mm. The curve A in FIG. 5(*a*) to FIG. 5(*d*) suggests that an input impedance of the plane antenna changes in accordance with frequency. Z51 is the impedance when the frequency is 800 MHz. Z52 is the impedance when the frequency is 950 MHz. Z53 the is impedance with the frequency is 1.1 GHz. Z0 is the point in the impedance of 50Ω matched with the impedance of the power feeding coaxial cable. Here, it can be understood that the impedance Z52 of the plane antenna, which is assumed to be used in the present invention, when the frequency is 950 MHz, is reduced to a lower value.

FIG. 6-A is a Smith chart of the plane antenna when the line width of the impedance-converting unit 4 of FIG. 3 is adjusted to 4 mm. FIG. 6-B is a Smith chart of the plane antenna when the line width of the impedance-converting unit 4 of FIG. 3 is adjusted to 5 mm. FIG. 6-C is a Smith chart of the plane antenna when the line width of the impedance-converting unit 4 of FIG. 3 is adjusted to 6 mm.

FIGS. 6-A to 6-C are Smith charts of the plane antenna when the line width of the impedance-converting unit 4 is changed to 4 mm, 5 mm, and 6 mm. The curve A in FIGS. 6-A to FIG. 6-C shows that an input impedance of the plane antenna changes in accordance with the frequency. Z61 is the impedance when the frequency is 800 MHz. Z62 is the impedance when the frequency is 950 MHz. Z63 is the impedance when the frequency is 1.1 GHz. Z0 is the point having the characteristic impedance of the power feeding coaxial cable of 50Ω. Here, it can be understood that the impedance Z62 when the frequency is 950 MHz shifts to the left side when the line width of the impedance-converting unit is increased.

Adjustments explained with reference to FIG. 5 and FIGS. 6-A to 6-C are attempted in the stage of trial manufacture before the manufacture of products. When the best plane antenna pattern is determined in the stage of trial manufacture, the products are mass-produced with the same pattern.

FIG. 7 illustrates a structure of a plane antenna product for a circularly polarized wave.

In the same antenna product, the surfaces thereof are covered with a front surface radome 13 and a rear surface radome 14 formed of ABS resin (dielectric constant $\in r=3.0$). A frame 15, 16 is integrally formed to the radome 13, 14 and is provided in contact with the front and rear surfaces of the plane antenna 71 in order to obtain a constant interval between the plane antenna 71 and the radome 13, 14. The radome 13, 14 is formed with the thickness of 2.5 mm. The interval between the frame 15 and the plane antenna 71 is set to 4.75 mm, while the interval between the frame 16 and the plane antenna 71 is set to 3.45 mm.

FIG. 8-A illustrates the antenna gain characteristic of the plane antenna product for a circularly polarized wave of FIG. 7. In this figure, it can be understood that the absolute gain in the direction of the front surface of the antenna when the frequency is 953 MHz is about 4 dBi as indicated at the front end of the arrow mark A. FIG. 8-B illustrates the VSWR (Voltage to Standing Wave Ratio) characteristic of the antennas as the parameter to know the impedance matching state of the plane antenna product for circularly polarized wave of FIG. 7. In this characteristic diagram, matching between the antenna power feeding point impedance and the impedance of the power feeding line can be known and it can also be understood that the front end of the arrow mark B has the VSWR value as low as 1.205 when the frequency is 953 MHz. Moreover, FIG. 8-C illustrates characteristics of the axial ratio of the circularly polarized wave from the antenna as the plane antenna product for circularly polarized wave of FIG. 7. In this characteristic diagram, it can also be understood that the axial ratio characteristic of the plane antenna in the direction of the front surface indicated at the front end of the arrow mark C is about −3 dB when the frequency is 953 MHz and the plane antenna of the present invention shows the circularly polarized wave largely approximated to a circle.

Figure 9:
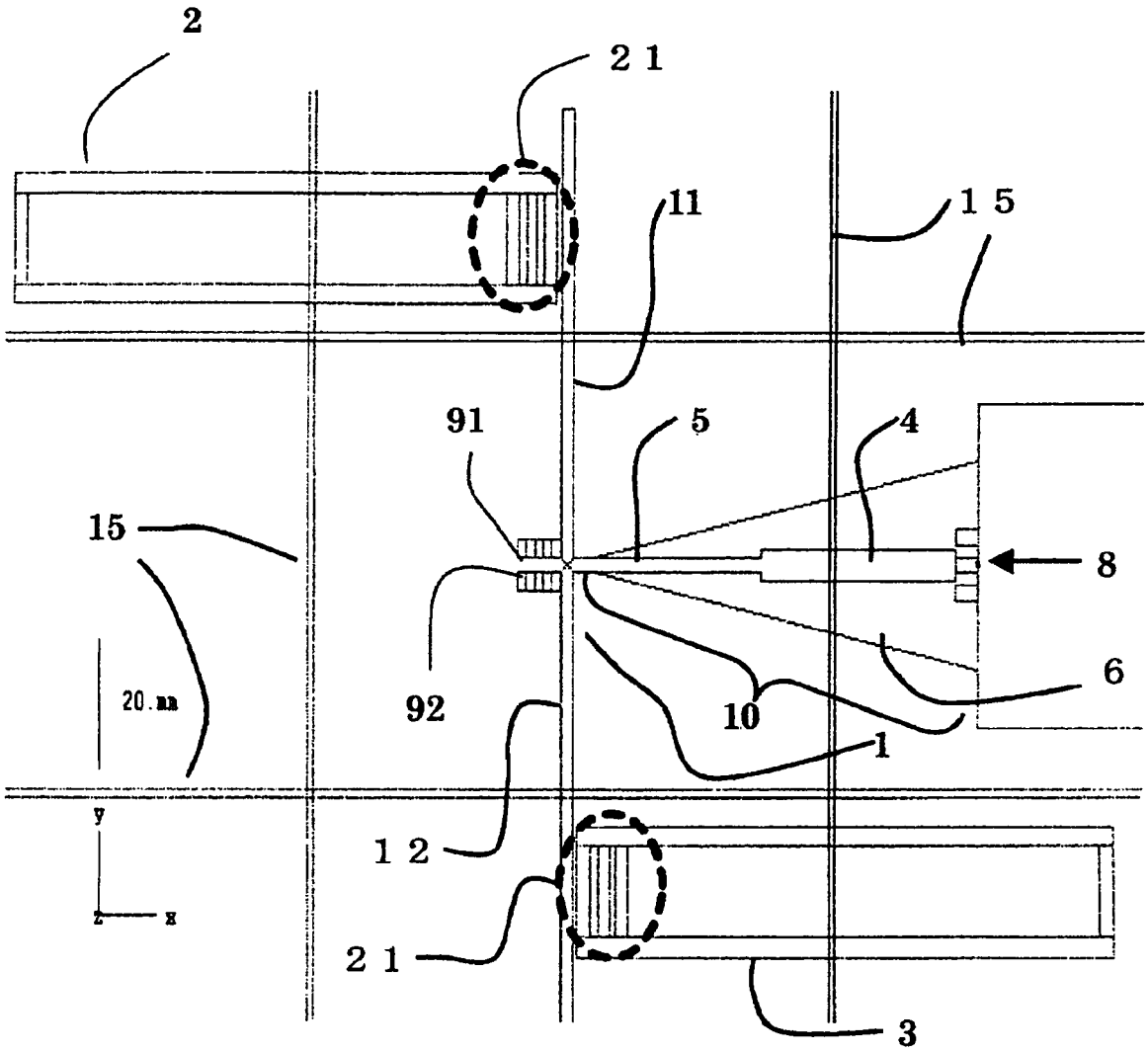
FIG. 9 is a diagram illustrating a structure of the plane antenna for adjustment of axial ratio of the present invention.

FIG. 9 illustrates a structure of a plane antenna for adjustment of the axial ratio.

Each element of FIG. 9 will be explained using like reference numerals when the element is similar to that used in FIG. 2 and FIG. 3. Moreover, the plane antenna of FIG. 9 is explained only when different from the antenna structure of FIG. 2 and FIG. 3.

In the dipole antennas 2, 3, the axial ratio of the circularly polarized wave radiated from the antenna can be adjusted by adjusting the adjacent distance to the dipole antenna 1 formed of the first antenna element 11 and the second antenna element 12. More concretely, the short side adjacent to the dipole antenna 1 of the loop antennas 2, 3 is formed of a plurality of short side patterns similar to a ladder. The short side of such ladder is defined as an axial ratio-adjusting unit 21. This short side is left by extracting only one of a plurality of patterns. The short side of the loop antenna 2, 3 can be adjusted in the interval from the dipole antenna of the plane antenna by employing the design explained above. Moreover, the short side is designed by leaving only one pattern from a plurality of patterns of the axial ratio adjusting unit 21 so that the adjacent interval between the loop antenna 2 and the first antenna element 11 becomes equal to that between the loop antenna 3 and the second antenna element 12.

The frame 15 illustrated in FIG. 9 is formed in a shape similar to a "#" in the plane antenna.

Here, it is considered that this plane antenna can be installed vertically like a bookend into a bookshelf in a library or a bookshop for utilization in stock management by reading the tags attached to the adjacent books on both sides.

The invention claimed is:

1. A plane antenna comprising:

a substrate having a first surface and a second surface;

a first radiating element, a first power feeding pattern connected to the first radiating element, and a first non-power feeding closed loop type radiating element provided adjacent to the first radiating element, all disposed on the first surface of the substrate; and a second radiating element, a second power feeding pattern connected to the second radiating element, and a second non-power feeding closed loop type radiating element provided adjacent to the second radiating element, all disposed on the second surface of the substrate;

wherein each of the first and second non-power feeding closed loop type radiating elements are rectangular shape and each has two short sides and two long sides, wherein each long side is longer than each short side;

wherein the first non-power feeding closed loop type radiating element is provided adjacent to the first radiating element at one of the short sides of the first non-power feeding closed loop type radiating element and located at one of the long sides in a right-angle direction to the first radiating element; and wherein the second non-power feeding closed loop type radiating element is provided adjacent to the second radiating element at one of the short sides of the second non-power feeding closed loop type radiating element and located at one of the long sides in a right angle direction to the second radiating element.

2. The plane antenna according to claim 1, wherein the first and second radiating elements form a dipole antenna.

3. The plane antenna according to claim 1, further comprising an impedance adjusting unit provided to a part of at least one of the first and second radiating elements.

4. The plane antenna according to claim 1, further comprising an impedance converting unit formed by changing a part of a pattern width of at least one of the first or second power feeding patterns of the plane antenna.

5. The plane antenna according to claim 1, wherein at least one of the first and second power feeding patterns of the plane antenna is formed in a shape of a triangle with the power feeding side defined as the bottom side of the triangle and the power feeding point of the corresponding radiating element defined as the vertex of the triangle.

6. The plane antenna according to claim 1, wherein at least one of the first and second power feeding patterns of the plane antenna is formed in a shape of an isosceles triangle with the power feeding side defined as the bottom side of the triangle and the power feeding point of the corresponding radiating element defined as the as the vertex of the triangle.

7. The plane antenna according to claim 1, wherein at least one of the first and second non-power feeding loop type radiating elements is further provided with an adjusting unit for adjusting an interval with an adjacent radiating element.

8. The plane antenna according to claim 1, further comprising an unbalanced-to-balanced converting unit.

9. The plane antenna according to claim 7, wherein the unbalanced-to-balanced converting unit is a part of the first power feeding pattern and comprises an impedance adjusting unit.

10. The plane antenna according to claim 8, wherein the second power feeding pattern is provided with an impedance converting unit formed by changing a part of a pattern width of the second power feeding pattern.

11. The plane antenna according to claim 1, wherein the plane antenna radiates a circularly polarized wave, and wherein the circularly polarized wave is radiated perpendicularly to a plane of the substrate.

* * * * *